US006419123B2

(12) United States Patent
Colquhoun

(10) Patent No.: US 6,419,123 B2
(45) Date of Patent: Jul. 16, 2002

(54) LIQUID SOAP DISPENSING CONTAINER

(76) Inventor: Mary Ellen Colquhoun, 2600 No. Flagler Dr. #710, West Palm Beach, FL (US) 33407

( * ) Notice: Subject to any disclaimer, the term of this patent is extended or adjusted under 35 U.S.C. 154(b) by 0 days.

(21) Appl. No.: 09/838,720

(22) Filed: Apr. 19, 2001

Related U.S. Application Data

(60) Provisional application No. 60/198,329, filed on Apr. 19, 2000.

(51) Int. Cl.[7] ..... B67D 5/06
(52) U.S. Cl. ..... 222/192; 222/130; 15/244.1
(58) Field of Search ..... 222/192, 130; 15/244.1; D6/542, 95; 206/77.1

(56) References Cited

U.S. PATENT DOCUMENTS

| | | | | |
|---|---|---|---|---|
| 4,353,694 A | * 10/1982 | Pelerin | 222/130 |
| D267,454 S | * 1/1983 | Fine | D6/95 |
| 4,938,345 A | * 7/1990 | Bolton | 206/77.1 |
| D341,973 S | * 12/1993 | Gerstmar | D6/542 |
| 5,678,733 A | * 10/1997 | Ong | 222/192 |

* cited by examiner

*Primary Examiner*—Philippe Derakshani

(57) ABSTRACT

A liquid soap dispensing container #1 that holds and dispenses liquid soap from a soap receptacle area #10. A sponge caddy area in the rear of the container #1 is comprised of a container sponge caddy partition #4, the left side of container #2, the right side of container #3 and the container floor #6. Removable #13 lid covers the soap receptable area. Lid #3 also covers, from above, the recessed sponge caddy area. When a sponge #9 or other cleaning pad is placed in the sponge caddy area, it is hidden from view from the front, from above, and from the left and right sides. The recessed sponge caddy area receives, organizes, holds and stores a kitchen sponge #9 or other cleaning pad, hidden from view as described above, and is accessible from the rear of container #1 thus a sponge #9 can easily be placed for storage and retrieved for use. When a sponge #9 is placed in the recessed sponge caddy area, it is held in place by sponge support bar with tab #7. Container #1 sits on and is elevated from the surface by a plurality of feet #12 attached to the outside of the container floor #6, creating air flow beneath the container #1. Air flow ridges #5 and air flow holes #8, allow air circulation around sponge #9, facilitating drying.

1 Claim, 6 Drawing Sheets

LIQUID SOAP DISPENSING CONTAINER

Figure 1:
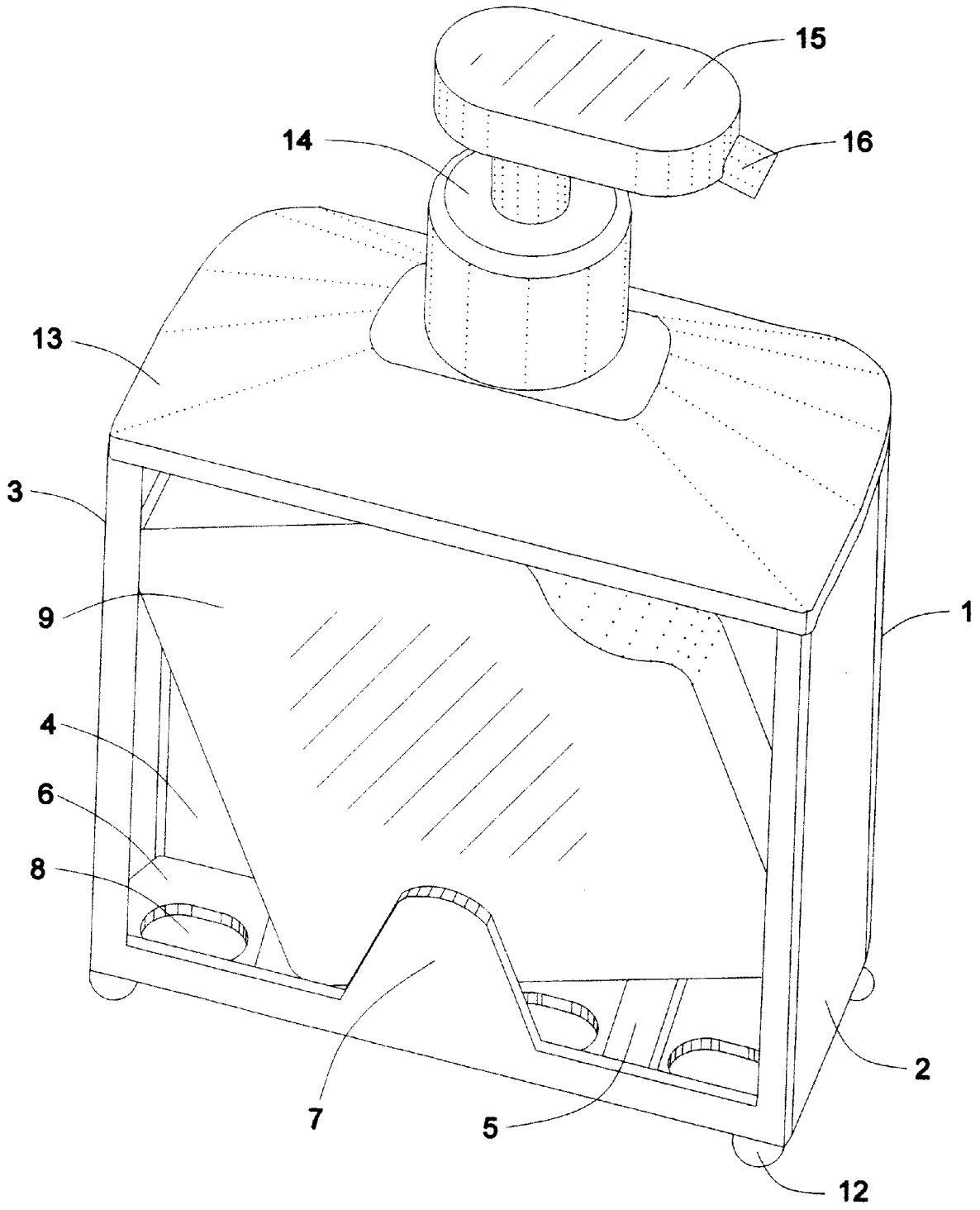

This application claims benefit to Provisional Application 60/198,329 filed Apr. 19, 2000.

BACKGROUND OF THE INVENTION

This invention relates to liquid soap dispensers and containers, especially those made to hold and dispense dishwashing detergent for use in the kitchen. This invention especially relates to liquid soap containers that sit on a counter top on or near the kitchen sink.

This invention also addresses the dilemma of the kitchen sponge that is often used in conjunction with a soap dispenser in the kitchen The kitchen sponge is not a decorative item, however, it usually is left lying in the open in plain view.

Most liquid soap dispensers are designed to hang on the wall and are more appropriate for commercial use due to the fact that they require attachment to the to the wall with screws or the like. U.S. Pat. No. 6,036,058—Liquid Soap Dispenser is typical of wall hung dispensers.

Other liquid soap containers are designed for lotion or for bathroom use and have few organizational or storage features for kitchen use. These are primarily design patents such as: D383,025—Liquid Soap Dispenser and D267,454—Liquid Soap Dispenser.

U.S. Pat. No. 5,678,733—Liquid Cleaner Dispenser stores a sponge in plain view, either on top, or in front of the detergent receptacle.

U.S. Pat. No. 4,831,681—Sponge Supporting Device with Guide Rod Springs also stores a sponge on top and in plain view which when depressed comes in contact with cleaning liquid stored below the sponge.

U.S. Pat No. D341,973—Combined Sponge Caddy and Fluid Dispensing Housing stores several cleaning items or implements in plain view in a large divided box attached to the side of the fluid dispensing housing.

The three (3) preceeding inventions store a sponge or other cleaning implement in the open and in plain view, just as it would be if left lying on the sink or countertop. U.S. Pat. No. D367,137—Combined Sponge and Liquid Dispenser and U.S. Pat. No. D330,788—Combined Sponge and Liquid Soap Dispenser for Washing Dishes describe sponges attached to devices that hold liquid soap and dispense that soap directly onto the sponge. The soap then passes through the sponge.

Although soap enclosure claimed in U.S. Pat. No 4,592,478—Container Assembly could be used as an enclosure for a sponge, it does not have an open area allowing a sponge to be easily retrieved, nor is air flow be provided.

U.S. Pat. No. 4,938,345—Dispensing and Draining Device claims a device that holds, stores, drains and dispenses cleaning articles but is not combined with a liquid soap dispenser.

BRIEF SUMMARY OF THE INVENTION

The Liquid Soap Dispensing Container described herein, is a soap dispensing container combined with a sponge caddy to hold and store a kitchen sponge. The sponge caddy area claimed herein is contained within the soap dispenser. The sponge caddy area is recessed in the rear of the soap dispenser and open and accessible from the rear of the soap dispenser. The recessed sponge caddy area has air flow ridges and holes to facilitate the drying of a sponge. The sponge and the recessed sponge caddy area are hidden from view from the front, from above, and from the left and right side of the soap dispensing container.

This invention eliminates the problem of how to keep the kitchen sponge or other cleaning pad handy and close to the kitchen soap, yet stored hidden from view since it is not an attractive item and with use can become very unsightly. With the use of this invention it is no longer necessary to keep the sponge or other cleaning pad inconveniently under the sink, nor lying in the open in the sink or on the countertop.

BRIEF DESCRIPTION OF THE VIEWS OF DRAWINGS

FIG. 1. Shows a rear perspective view of a soap dispensing container with a sponge being removed from the recessed sponge caddy area.

Figure 2:
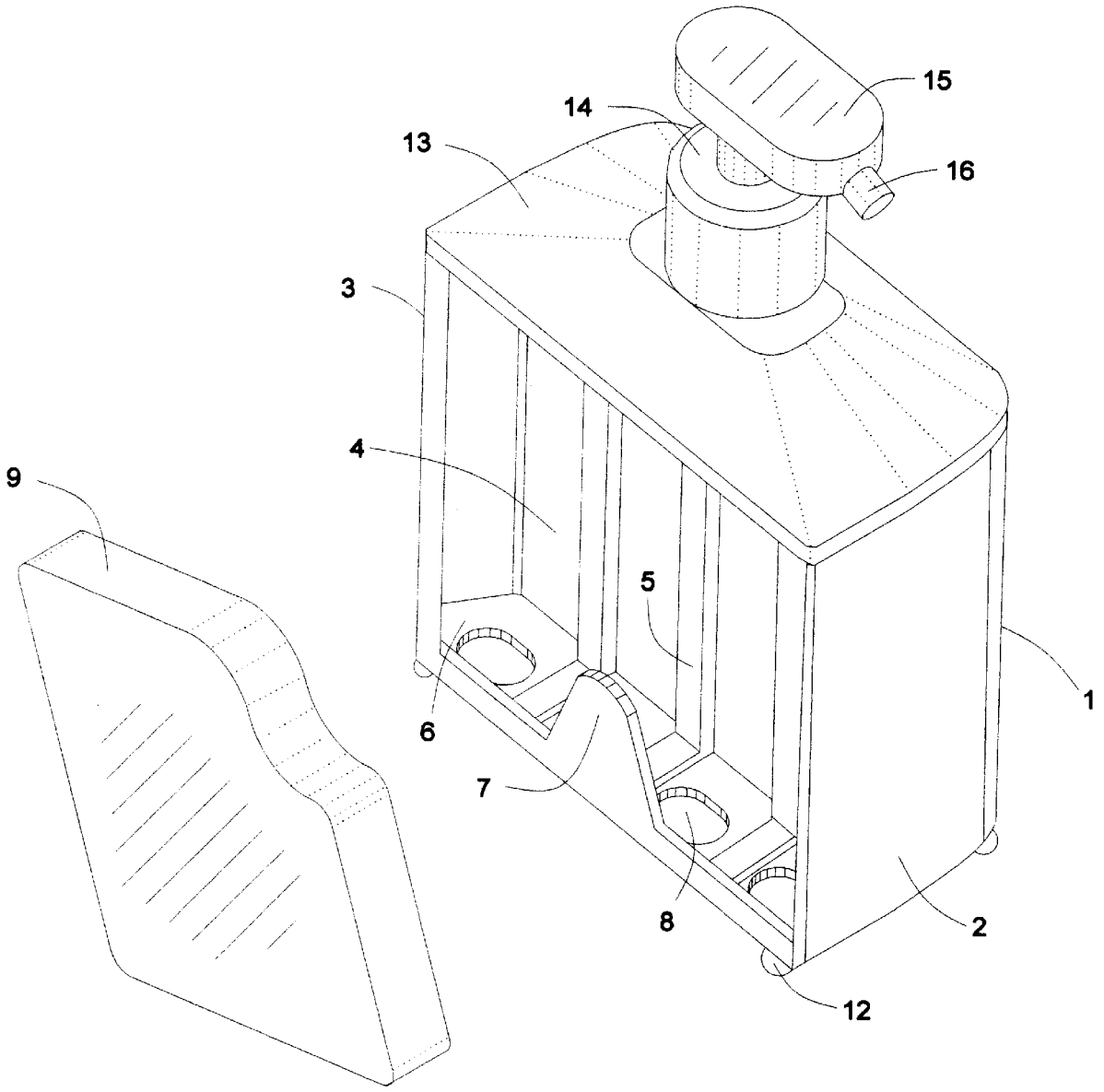

FIG. 2. Shows a rear perspective view of a soap dispensing container with a sponge removed to reveal details of the recessed sponge caddy area.

Figure 3:
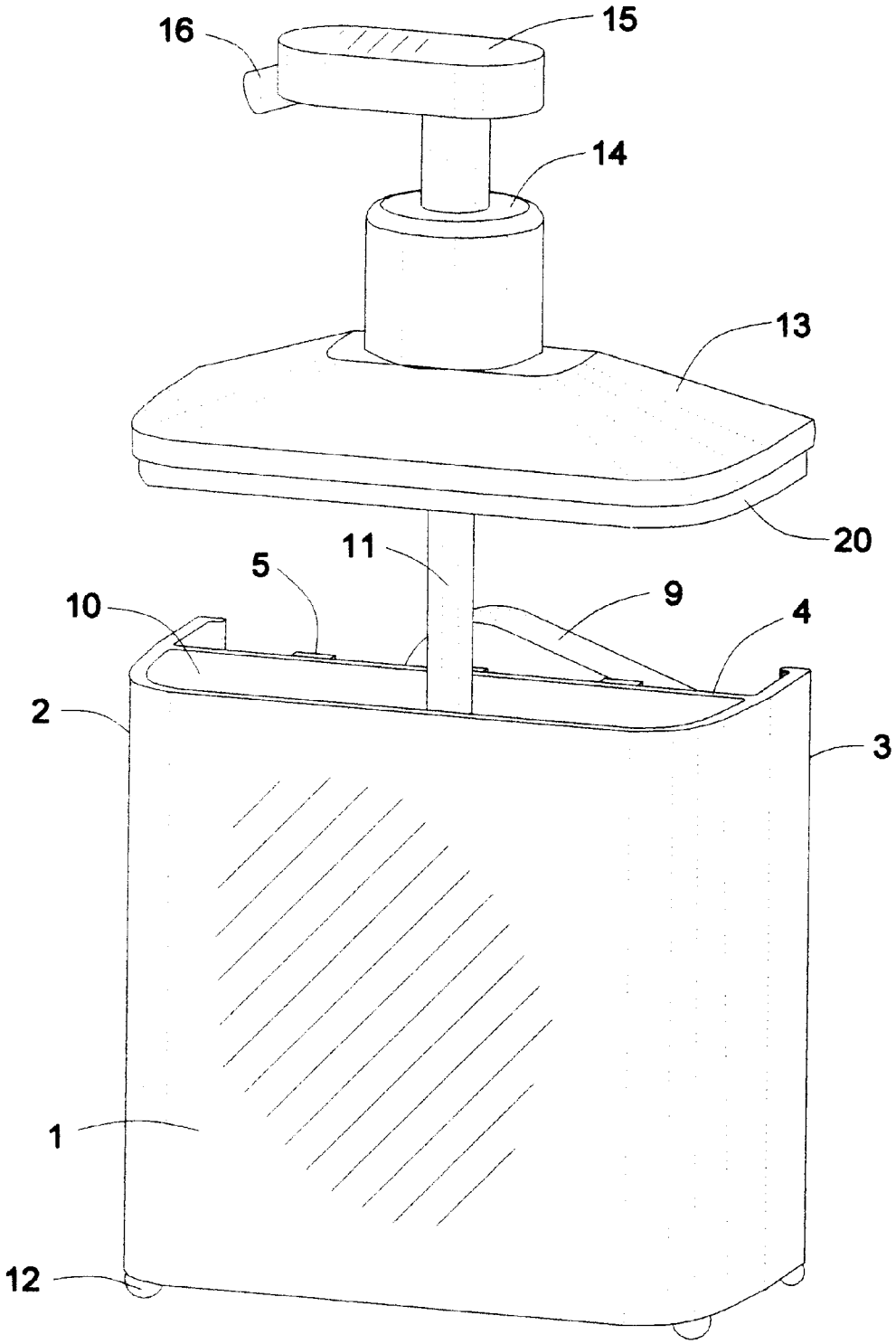

FIG. 3. Shows a front perspective view of a soap dispensing container with the lid released from the container to reveal the soap receptacle and stored sponge.

Figure 4:
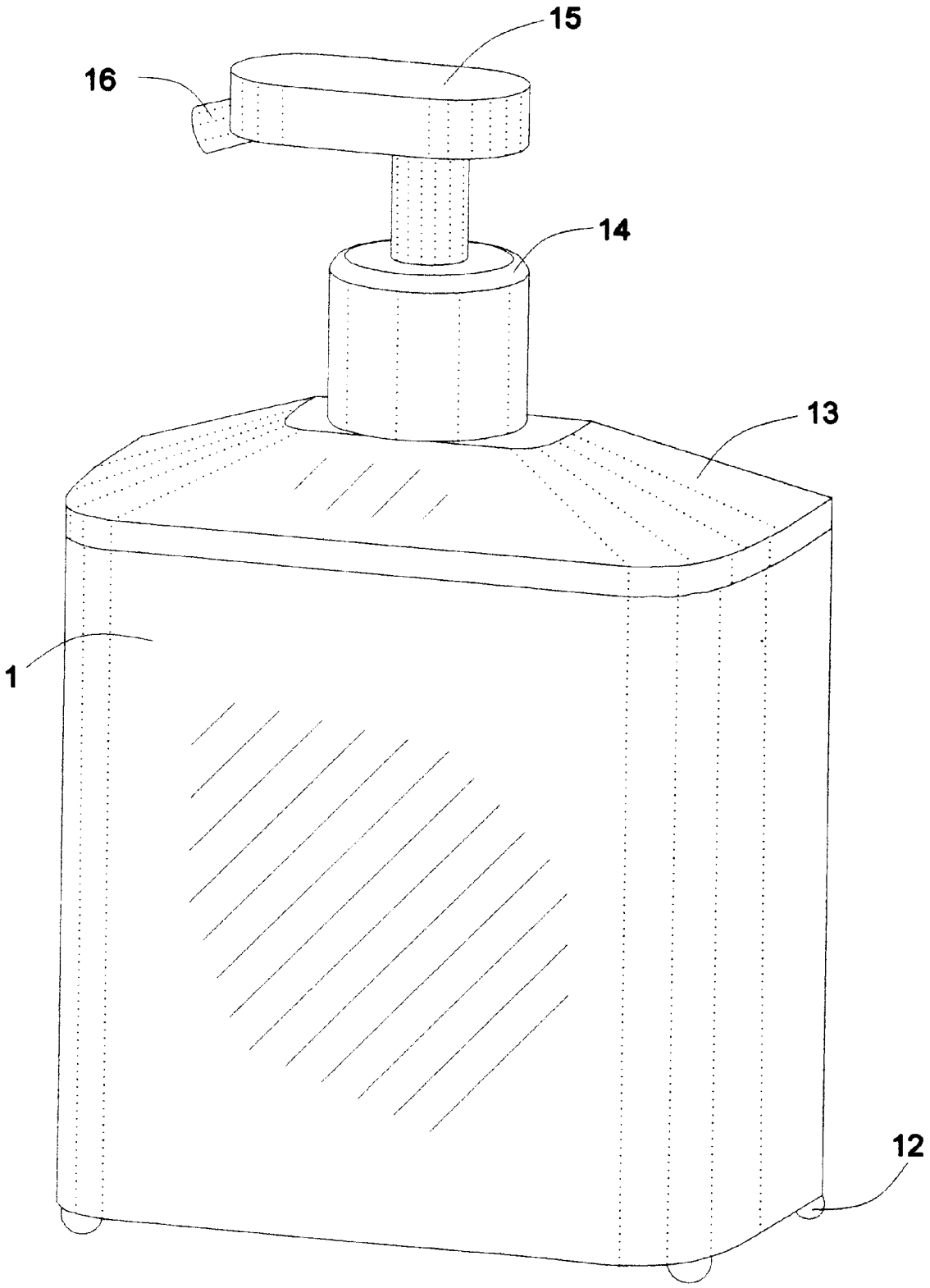

FIG. 4. Shows a front perspective view of a soap dispensing container with the lid in position on top of the container.

Figure 5:
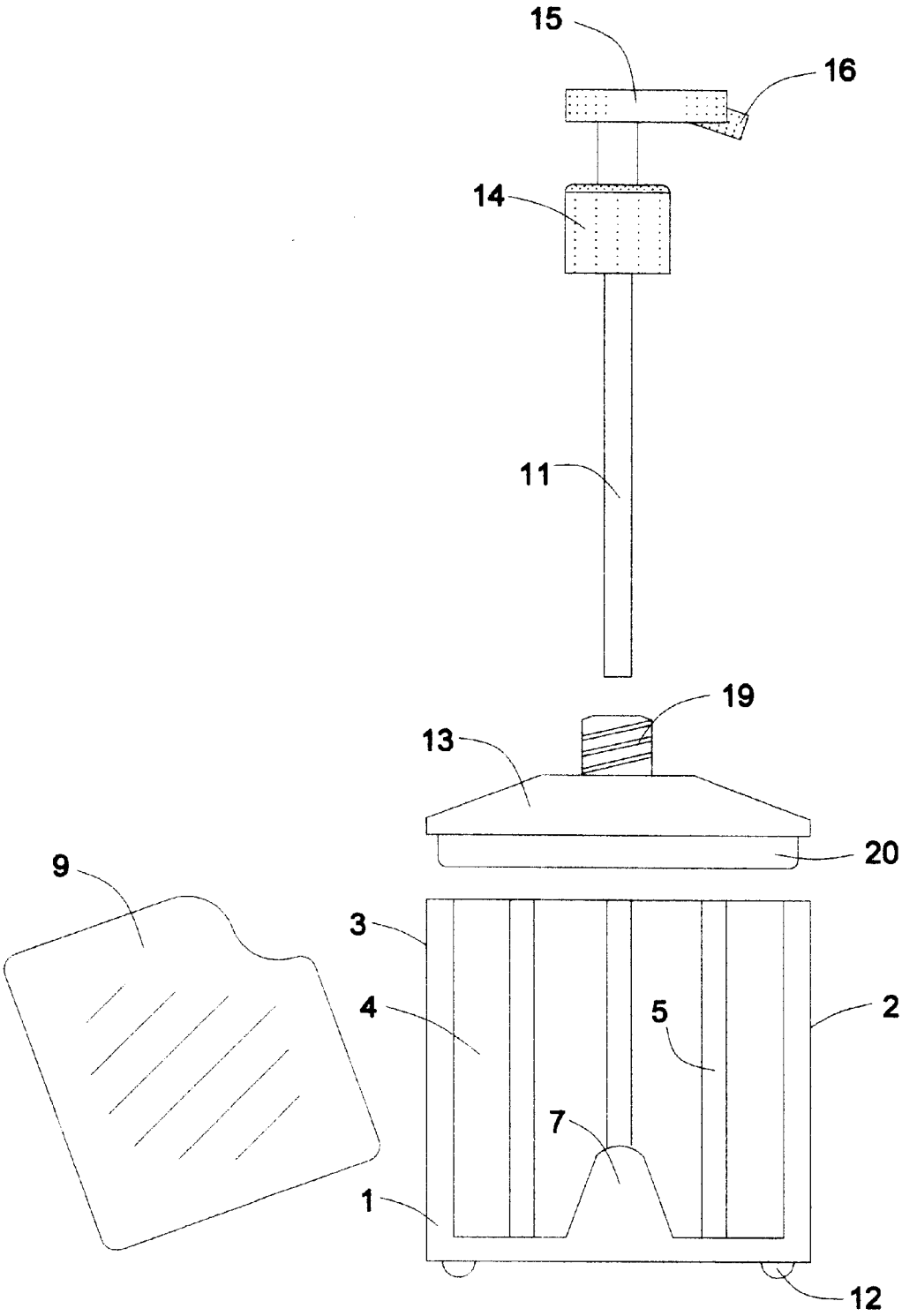

FIG. 5. Shows a rear view of a soap dispensing container with a sponge removed from the recessed sponge caddy area, the lid released from the container and a pump assembly released from the lid.

Figure 6:
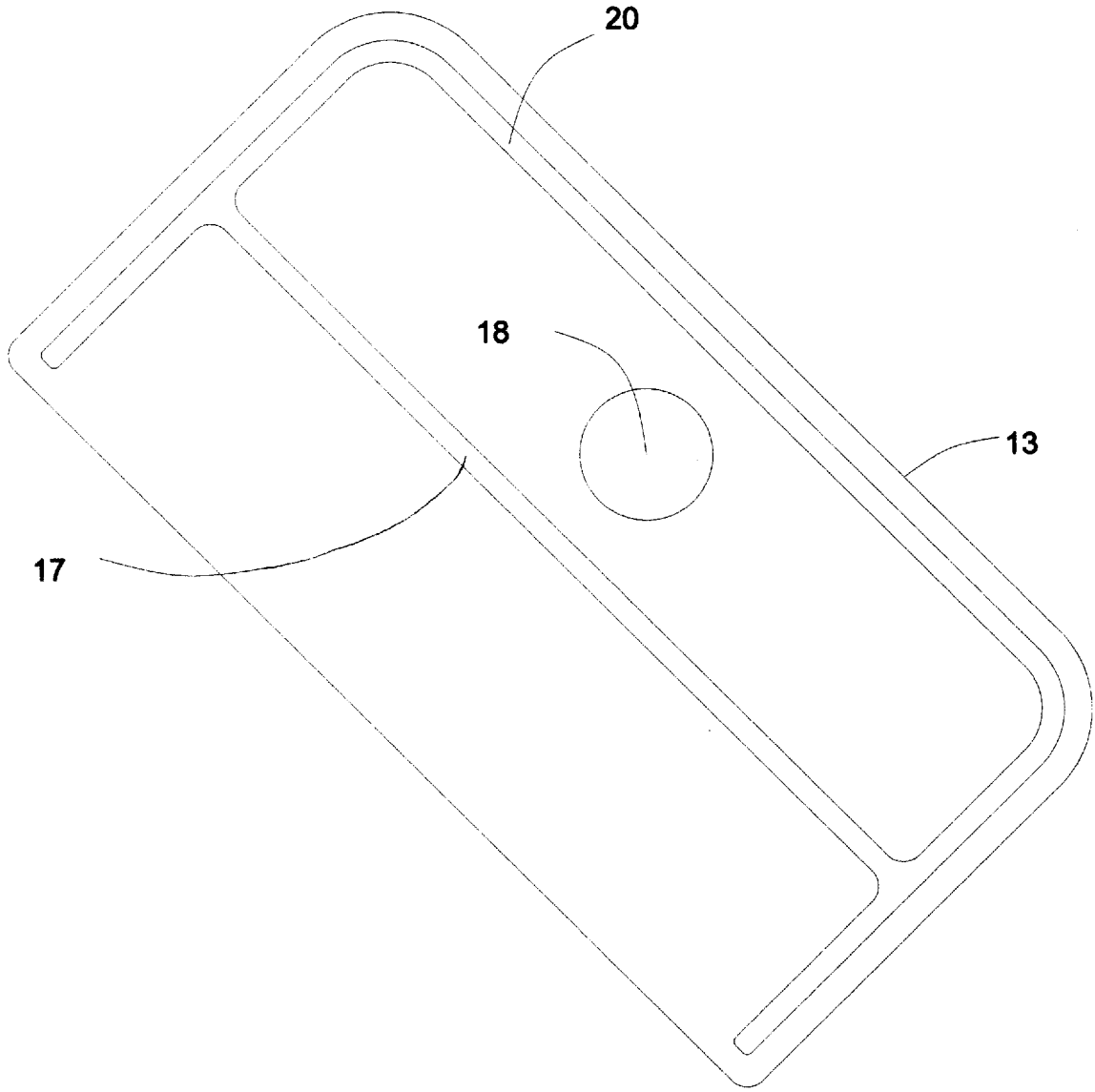

FIG. 6. Shows inside/underside view of a lid revealing the lid sponge caddy partition

REFERENCE NUMERALS IN DRAWING

1. Container
2. Left side of container
3. Right side of container
4. Container sponge caddy partition
5. Air flow ridges
6. Container floor
7. Sponge support bar with tab
8. Air flow holes
9. Sponge
10. Soap receptacle area
11. Pump tube
12. Feet
13. Lid
14. Pump cap
15. Pump top
16. Pump spout
17. Lid sponge caddy partition
18. Pump tube hole
19. Threaded neck
20. Lid lip

DETAILED DESCRIPTION OF THE INVENTION

A typical embodiment of this invention is illustrated in FIG. 1. FIG. 1 shows the perspective rear view of a soap dispensing container with a sponge being removed from a recessed sponge caddy area.

A recessed sponge caddy area is created within the rear interior of container #1 and on the back/rear side of container sponge caddy partition #4. The recessed sponge caddy area is formed by the left end of container sponge caddy partition #4 bisecting, and being attached to the left side of container #2, and the right end of container sponge caddy partition #4 bisecting and being attached to the right side of container #3. This recessed sponge caddy area holds and stores a sponge #9. Sponge #9 rests on the rear sponge caddy portion of container floor #6. The recessed sponge caddy area and sponge #9 are covered from above by a removable lid #13, shown fitted to the top of container #1. Recessed sponge caddy area is open from the rear for easy access to insert or retrieve a sponge #9.

A plurality of feet #12 are attached to the outside of the bottom of container floor #6. Feet #12 elevate container #1 from the surface it rests on thereby permitting air flow beneath the container. Air flow holes #8, occurring at regular intervals, pierce the sponge caddy portion of container floor #6. Air flow holes #8 allow air circulation under container #1 to pass through air flow holes #8, thereby facilitating drying of sponge #9.

The left end of the sponge support bar with tab #7 is attached to the bottom end of left side of container #2. The right end of the sponge support bar with tab #7 is attached to the bottom end of the right side of container #3. Sponge support bar with tab #7 is also attached to the full length of the outer edge of the sponge caddy portion of container floor #6. Sponge support bar with tab #7 holds a sponge #9 in place when the sponge #9 is stored in the recessed sponge caddy area that is formed by the left side of container #2, right side of container #3, the rear side of container sponge caddy partition #4, and the sponge caddy portion of container floor #6.

A sponge #9 or other cleaning pad is easily guided into place in the recessed sponge caddy area by and between container sponge caddy partition #4 and sponge support bat with tab #7.

A dispensing pump assembly, as illustrated in FIG. 1. is comprised of #14 pump cap, #15 pump top and #16 pump spout. It is shown solely for the purpose of representing how the soap dispenser container, with recessed sponge caddy area, will receive and hold a pump assembly.

FIG. 2. Shows a rear perspective view of a soap dispensing container with a sponge removed revealing details of the recessed sponge caddy area.

In addition to the previously described air flow holes #8, air flow ridges #5 provide additional air flow to sponge #9. The rear surface of container sponge caddy partition #4 and the inside of sponge caddy portion of container floor #6 are covered, at regular intervals, with a series of air flow ridges #5. Air flow ridges #5 are raised from the surface, project out, and extend the full height of container sponge caddy partition #4 and continue along the fill depth of the inside of the sponge caddy portion of container floor #6. Air flow ridges #5 keep sponge #9 from coming in contact with and resting on the rear surface of container sponge caddy partition #4. Air flow Ridges #5 also keep sponge #9 from coming in contact with and resting on the inside of sponge caddy portion of container floor #6. Air circulation is hereby allowed between the rear surface of container sponge caddy partition #4 and sponge #9, as well as between the inside of sponge caddy portion of container floor #6 and bottom edge of sponge #9.

FIG. 3. Shows a front perspective view of a soap dispensing container with the lid released from the container revealing the soap receptacle area.

A soap receptacle area #10 is formed on the front side of the container sponge caddy partition #4. The soap receptacle area #10 is formed by the left end of container sponge caddy partition #4 bisecting and being attached to the left side of container #2 and the right end of container sponge caddy partition #4 bisecting and being attached to the right side of container #3 forming an area to hold and store liquid soap. Container sponge caddy partition #4 divides the front soap receptacle area #10 from the rear recessed sponge caddy area that holds and stores sponge #9.

Lid lip #20 is attached to the inside/underside of lid #13 and recessed under the edge of lid #13. Lid lip #20 creates a seal between lid #13 and the top edge of container #1 when lid lip #20 is inserted inside the top edge of container #1. This results in the proper placement of lid #13 on container #1. When lid #13 is removed from container #1, liquid soap can be poured into soap receptacle area #10.

FIG. 4. Shows a front perspective view of a soap dispensing container with the lid In position on top of the container.

Lid #13 is shown positioned in place on top of container #1 covering from above, the soap receptacle area #10 and the recessed sponge caddy area. This view illustrates how a soap dispensing container with recessed sponge caddy area will appear when it is placed for its intended use on the sink or on the countertop. Sponge #9 and recessed sponge caddy area are hidden from view from the front, from above, and from left and right sides. FIG. 4 also illustrates how lid #13 covers and conceals sponge #9 from view from above and how left side of container #2 and right side of container #3 cover and conceal view from left and right sides of container #1. Sponge #9 and recessed sponge caddy area are easily accessible from the open rear of container #1 without the removal of lid #13 Lid #13 also covers liquid soap held and stored in soap receptacle area #10.

FIG. 5. Shows an exploded rear view of a soap dispensing container with a sponge removed from the recessed sponge caddy area, the lid released from the container and a pump assembly released from the lid.

Illustrated here is #19 threaded neck which when threaded with the corresponding threads on pump cap #14, connect pump assembly to lid #13. Entire pump assembly is comprised of pump tube #11, pump cap #14, pump top #15 and pump spout #16.

FIG. 6. Shows inside/underneath view of a lid revealing the lid sponge caddy partition.

Lid sponge caddy partition #17 is attached to the length of the inside roof of lid #13. The left end of lid sponge caddy partition #17 bisects and is further attached to the inside of lid #13 on the left side of lid #13 and also the inside of lid lip #20. The right end of lid sponge caddy partition #17 bisects and is further attached to the inside of lid #13 on the right side of lid #13 and the inside of lid lip #20. Lid sponge caddy partition #17 divides and separates the the inside of lid #13 into a front area and a rear area. When lid #13 is placed in position on top of container #1, the full length of the bottom edge of lid sponge caddy partition #17 meets and rests on the full length of the top edge of container sponge caddy partition #4. This meeting of two parts completes the separation and division of the front soap receptacle area #10 from the rear recessed sponge caddy area. This separation and division extends from the inside roof of lid #13 down to the inside of container floor #6 keeping liquid soap that is stored in soap receptacle area #10 from spilling over into the recessed sponge caddy area.

FIG. 6 Illustrates pump tube hole #18 in the lid #13. Pump tube #11, as shown in FIG. 3, passes through pump hole #18 as shown in FIG. 6 and extends down into soap receptacle area #10. Liquid soap contained in soap receptacle area #10 is pumped up through pump tube #11 and expressed out of pump spout #16 by depressing pump top #15, referred to in FIG. 3.

Thus, the reader can see that the soap dispensing container with recessed sponge caddy area to receive, organize, hold and store a kitchen sponge or other cleaning pad, is a useful and unique product. Combining a soap dispenser with a sponge caddy area that is recessed within the soap dispenser is a space saving, as well as organizational device. When placed on the back of the sink or beside it on the countertop, the recessed sponge caddy also keeps the unattractive kitchen sponge hidden from the view of the cook.

The best mode to make the soap dispensing container is through the process of plastic injection molding. The favored form is in two parts made of ABS plastic.

This invention can be made of many materials, including plastic, ceramic, metal and combinations of the foregoing, to name a few.

Although the description above contains specificities, these should not be construed as limiting the scope of the invention but as merely providing illustrations of some of the presently preferred embodiments of this invention. For example, the soap dispensing container can be made in one piece without the top being removable which would require filling the soap receptacle through the hole in the neck. The recessed sponge caddy area can be made in different shapes and sizes.

Thus the scope of the invention should be determined by the claims and their legal equivalents, rather than by the examples given.

What I claim as my invention is:

1. A liquid soap pump container comprising a first compartment to enclose a pump dip tube, a second compartment recessed within the container to store a sponge in the vertical direction, said second compartment including integrally formed ridges extending in said vertical direction, said second compartment having a container floor including holes, and said second compartment having a tab extending from the sponge floor to support the sponge in said vertical direction.

* * * * *